United States Patent [19]

Walski

[11] 4,058,285

[45] Nov. 15, 1977

[54] APPARATUS TO ADJUST AND MAINTAIN THE DISTANCE BETWEEN WALL FORMS

[75] Inventor: Stanley Walski, Media, Pa.

[73] Assignee: Con-Spec Devices Inc., Wilmington, Del.

[21] Appl. No.: 689,726

[22] Filed: May 25, 1976

[51] Int. Cl.[2] ..... E04G 17/08

[52] U.S. Cl. ..... 249/216; 249/46; 249/219 W

[58] Field of Search ..... 249/40–46, 249/190–191, 213–214, 216–217, 219 W; 248/205 R

[56] References Cited

U.S. PATENT DOCUMENTS

| | | | |
|---|---|---|---|
| 3,693,931 | 9/1972 | Holt | 249/46 |
| 3,972,501 | 8/1976 | Plough | 249/42 |
| 3,981,476 | 9/1976 | Alexander et al. | 249/42 |

*Primary Examiner*—Francis S. Husar
*Assistant Examiner*—John McQuade
*Attorney, Agent, or Firm*—Karl W. Flocks

[57] ABSTRACT

A back side plate and a front side plate having a screw type wall tie passing therethrough maintain a strongback or waler therebetween by connecting tension stud bolts with a panel or wall form attached to a shelf portion of the back side plate with adjustments made through a housing and a keeper in conjunction with a nut which can be turned on the screw type wall tie.

18 Claims, 9 Drawing Figures

APPARATUS TO ADJUST AND MAINTAIN THE DISTANCE BETWEEN WALL FORMS

BACKGROUND OF THE INVENTION

The present invention relates to spacing of walls in the construction industry such as wall panels or wall form faces which are spaced to form the thicknesses of concrete walls, with wall ties connecting opposing walls and passing through the poured concrete. Most prior art wall forms must have special systems built specifically for that wall form and in addition may require special tools for adjustment purposes.

Use of screw type wall ties is known in the prior art but the hardware used in conjunction with such wall ties shows the use of special mounts and other parts which may require special tools for assembly or disassembly and which may be built for use with a particular wall form.

SUMMARY OF THE INVENTION

The present invention is adaptable to spacing of wall panels including wall form faces and the maintaining of the distance between said wall faces.

The present invention is a system to hold and attach strongbacks and walers to any wall forms.

A further object of the present invention is to provide a space for centering and the passage of ties which maintain the spacing and may be used to adjust the spacing between wall forms.

An advantage of the present invention is that the system may be used and adapted for use with many different forms presently on the market.

A further object of the system is the provision of a nut used in conjunction with any threaded tie, being made captive so that a wall form can be moved in or out by the turning of the nut.

The present invention is adapted for use with ties passing through members which are to be spaced from each other with the spacing adjustable but maintained once the adjustment has been made.

BRIEF DESCRIPTION OF THE DRAWINGS

The above and other objects and advantages of the invention will become apparent upon full consideration of the following detailed description and accompanying drawings in which.

DESCRIPTION OF THE PREFERRED EMBODIMENTS

Figure 1:
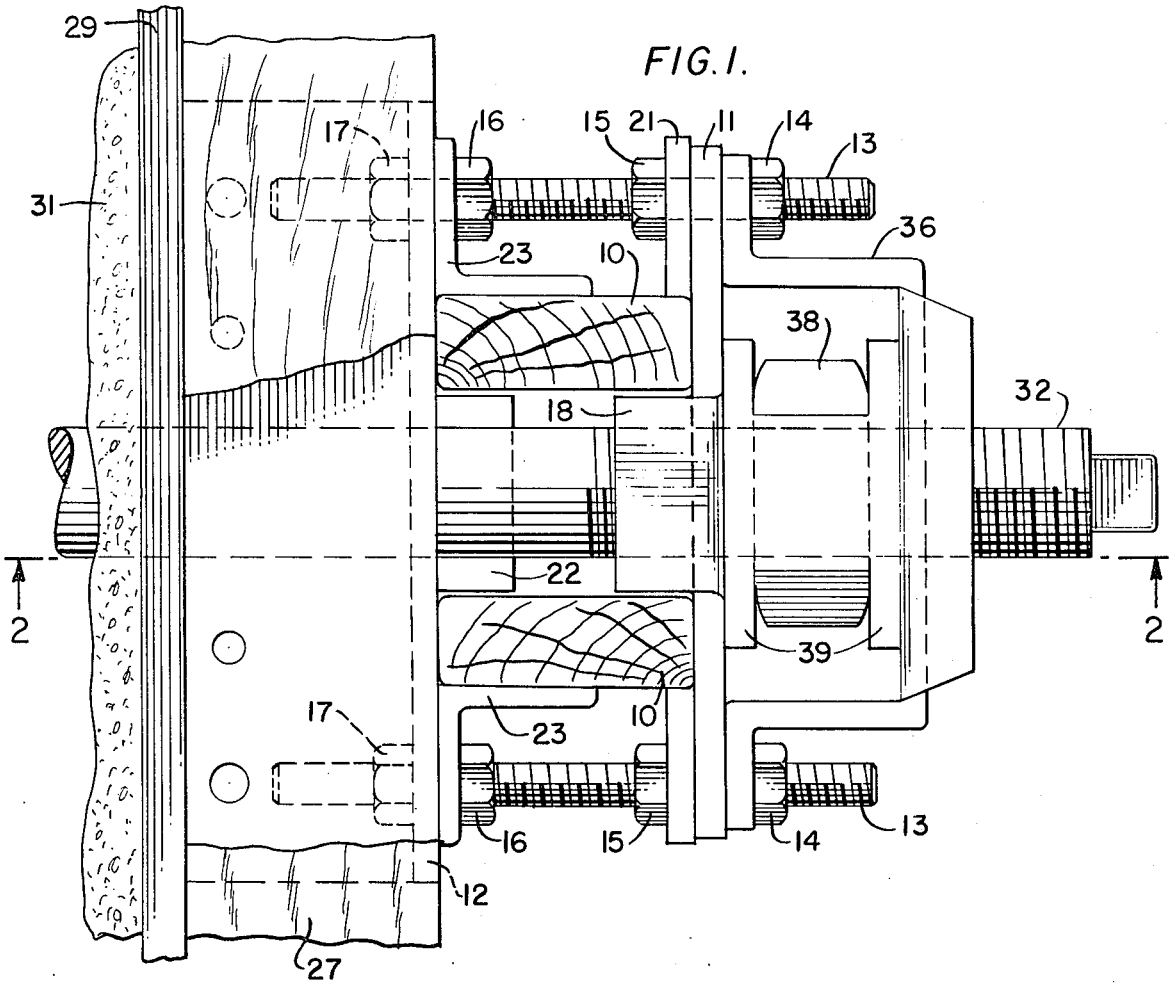
FIG. 1 is a plan view of the system of the present invention on the outside of the spacing between wall forms on one end of a tie.
Figure 2:
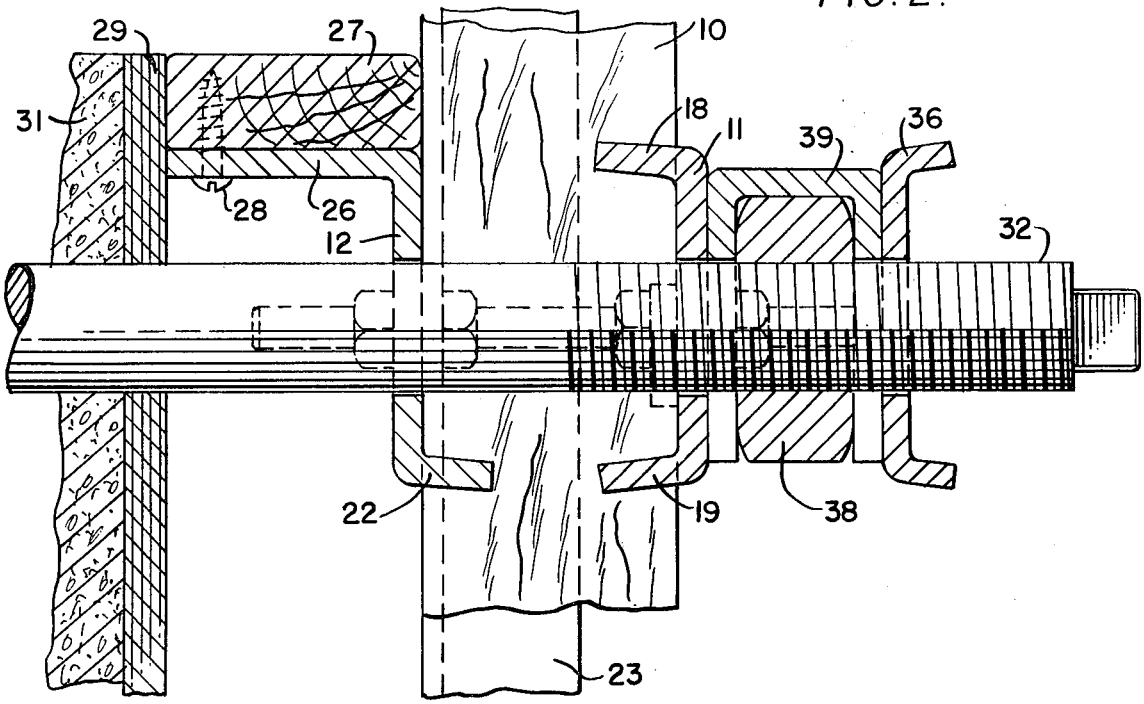
FIG. 2 is a section view along line 2—2 in FIG. 1.
Figure 3:
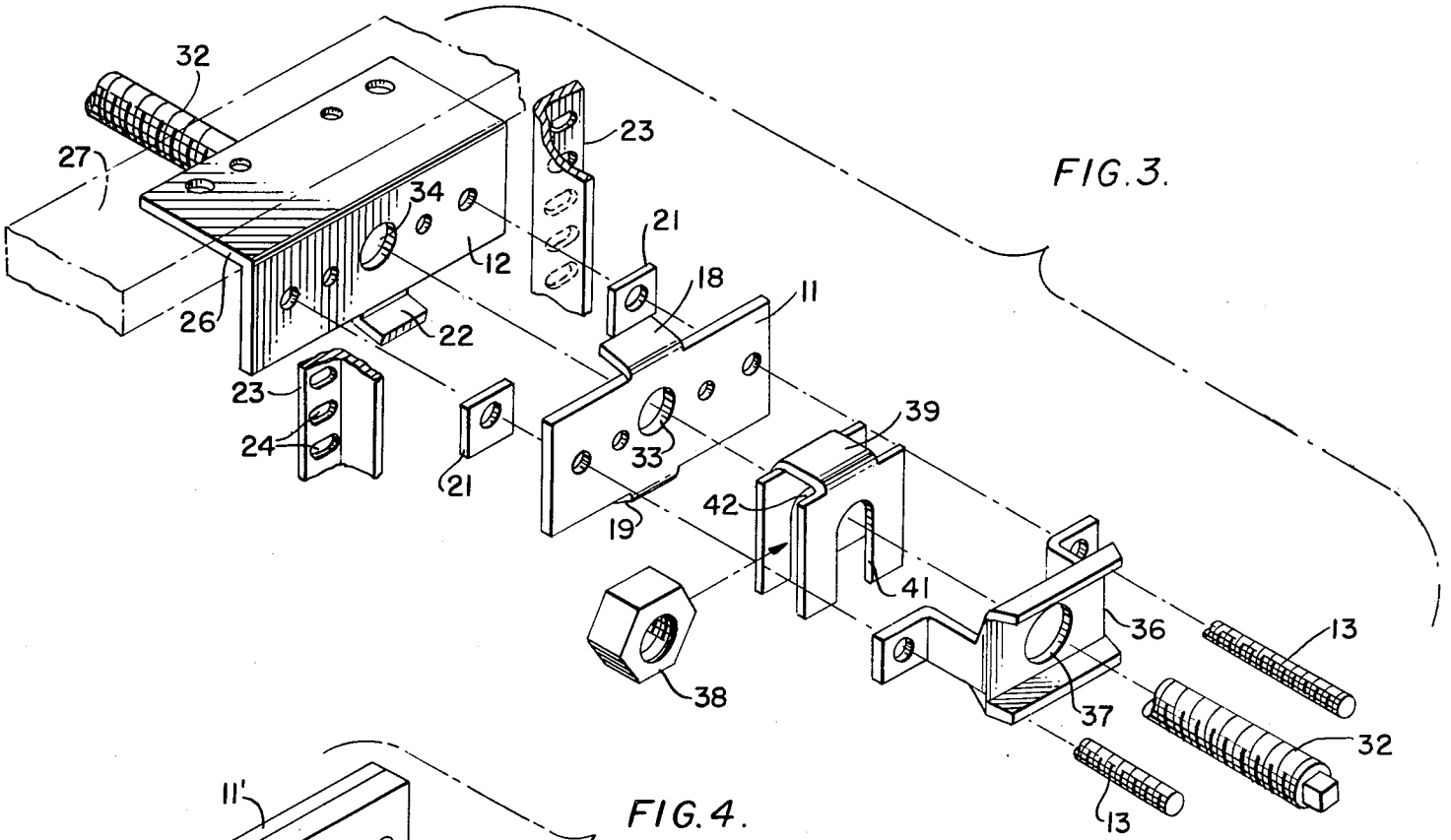
FIG. 3 is an exploded perspective view of the portion of the system shown in FIGS. 1 and 2.

Referring first to the embodiment of FIGS. 1 through 3 there is shown the use of the present system with building members such as wall forms for forming concrete structures therebetween but this system should not be considered only in this regard since other structural uses are of importance such as positioning of other building members such as panels and maintaining the position of these panels in a structure are equally applicable. In these figures strongbacks or walers which are structural members shown in figures as wooden planks but which may be steel channels are supported in a vertical position and tied together in systems as in the present invention. Members 10 are maintained between a front side plate 11 and a back side plate 12. Tension stud bolts 13 pass through front and back side plates 11 and 12 respectively and by means of nuts 14 through 17 on each of bolts 13 maintain the clamping pressure of side plates 11 and 12 against strongback or waler 10. Besides the clamping pressure on opposite edges of the strongback or waler 10 from front and back side plates 11 and 12 pressure is applied to both side faces of strongback or waler 10 in order to further hold them in position and against any movement. On front side plate 11 are turned up portions 18 and 19 on the top and bottom respectively of plate 11 and centered on those top and bottom edges. Portions 18 and 19 press against the inside faces of members 10 near the front side plates with this force opposed by punched off-center washers 21 located between front side plate 11 and nut 15 on each of tension stud bolts 13 and rotated to a position so that due to the off-center punching a part of each of washers 21 presses against the outside faces of members 10. Back side plate 12 has a turned up portion 22 centered along its lower edge which presses against the inside faces of members 10 near back side plate 12. Again an opposing force on the outside faces of members 10 is applied by one portion of a vertical slotted washer in the form of a continuous bar or angle 23 through whose slots 24 the tension stud bolts 13 pass. The slotted portion of angles 23 is maintained on bolts 13 between nuts 16 and back side plate 12. A leg of angle 23 perpendicular to the leg with the slots therein presses against the outer faces of structural members 10.

A shelf 26 is formed at a right angle to and integral with back side plate 12 for use as a support or fastener for any form system. For use with the wall form illustrated a plank or wall form portion 27 is attached to shelf 26 by screws 28 passing through shelf 26 and attached into wall form portion 27. A wall form face 29 is connected to wall form portion 27 by usual means such as nailing or other. On the other side of concrete 31 a similar wall form face 29 supports the concrete 31 in the enclosure and a system similar to that shown in FIGS. 1–3 is found at the other end of screw type wall tie 32.

Screw type wall tie 32 passes through holes 33 and 34 in front side plates 11 and back side plate 12 respectively. These holes 33 and 34 are centered on plates 11 and 12 respectively and are of a large enough size sufficient to receive wall ties 32 including such wall ties as may have enlarged center portions which pass through the wall forms and concrete. The enlarged center portioned type of wall tie is known per se and is not shown in the figures since the dimensions do not form a novel form of the present invention.

Attached to front side plate 11 by tension stud bolts 13 and nuts 14 is a substantially U-shaped housing member 36 having a center opening 37 which is large enough to allow the entry of nut 38 mounted on tie 32 to pass therethrough. This is an aid in the assembly and disassembly of the system. Turned up portions shown on U-shaped housing member 36 are for purposes of strength because of the additional strength of a channel over that of a plate. With the nut 38 positioned within housing member 36 it is maintained therein by a keeper 39 which is a U-shaped front and back washer with each of the legs of the U having a downwardly open slot 41 and 42 in the front and back portions respectively. The slots are wide enough to allow wall tie 32 to pass therethrough but not wide enough to allow the passage of nut 38 therethrough. Nut 38 is therefore confined within the front and back portions of keeper 39 once the keeper is slid downward over wall tie 32.

With keeper 39 in place nut 38 is rotated so as to move toward or away from wall form face 29 and by its movement along wall tie 32 to force the movement of wall form face 29 either toward or away from its opposing wall form face on the opposite end of wall tie 32. As can also be seen from a study of the structure disclosed a wrench placed on the end of wall tie 32 which is formed so as to allow holding by such a wrench allows one to prevent the turning of wall tie 32. At the same time the rotation of nut 38, while wall tie 32 is prevented from rotation, if outward along wall tie 32, forces keeper 39 and housing member 36 outward along wall tie 32. This outward movement of housing member 36 which is rigidly attached to front side plate 11 and back side plate 12 by tension bolts 13 causes the movement outward along wall tie 32 of both side plates. Since the wall form face and wall form portion 29 and 27 respectively are rigidly attached to back side plate 12, these must also move outward along wall ties 32 thus causing the separation of wall form face 29 from its opposing wall form face which is located on the opposite side of the space which may contain concrete 31, on the opposite end of wall tie 32.

In a similar manner by holding wall tie 32 against rotation and rotating nut 38 along wall tie 32 inward away from the end of wall tie 32 movement of keeper against front side plate 11 along with all attached hardware in a manner similarly described above moves wall form face 29 inward along wall tie 32 closer to an opposing wall form face on the opposite end of wall tie 32.

Members 10 which as discussed above are strongback or walers by their dimensions can be considered to strengthen the construction of the wall forms and thus support a much greater weight and larger surface of concrete 31 between opposing wall form faces 29.

Figure 4:
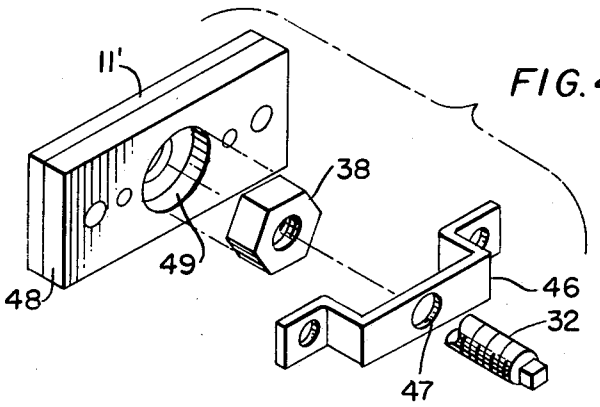
FIG. 4 is a modified form of the system of the present invention.

FIG. 4 which is a modification of the above-described system utilizes a U-shaped housing member 46 having a centered opening 47 to receive a screw-type wall tie 32 on which nut 38 rides. A front side plate 11[1] similar to front side plate 11 but only partially shown here has attached to it a keeper plate 48 having a center hole 49 large enough in diameter to receive nut 38. In moving the wall forms of the system inwards towards each other the nut 38 is moved along wall tie 32 into hole 49 to apply pressure against front side plate 11[1] and move attached hardware in a manner described in connection with the first embodiment. Outward movement of nut 38 toward the end of wall tie 32 while at the same time preventing rotation of tie 32 causes adjustment outward of the wall forms away from each other. After any adjustment is made nut 38 is rotated within hole 49 so as to fit against front side plate 11[1] and prevent outward movement of the wall forms due to pressure of the concrete being poured.

Figure 5:
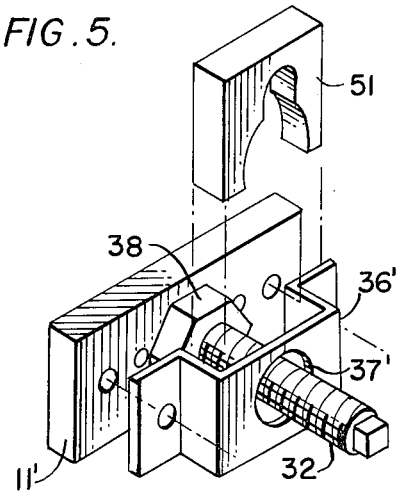
FIGS. 5, 6, and 7 are a further modification of the systems.
Figure 6:
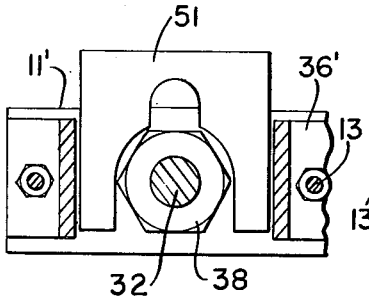
Figure 7:
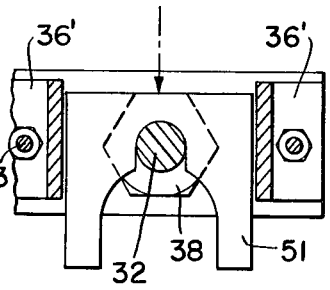

FIGS. 5, 6, and 7 show still another embodiment of the present invention with front side plate 11[1] connected in the manner of front side plate 11 previously described. A U-shaped housing member 36[1] which may be constructed in a manner similar to housing member 36 has an enlarged hole 37[1] through which nut 38 can be passed along screw type wall tie 32. Once nut 38 has been moved up against front side plate 11[1] a sliding lock plate 51 having a slot therein with a widened portion near the bottom big enough for nut 38 to pass through and a narrower portion above that just sufficient to pass around wall tie 32 is inserted as shown in FIG. 7. Rotating of nut 38 so as to pass it along wall tie 32 exerts forces so as to cause connected portions of housing member 36 and front side plate 11[1] along with the connected parts as described with the previous embodiments to move inward or outward along wall tie 32 and thereby move wall forms toward or away from each other. Tension stud bolts 13 with nuts thereon are used in all embodiments described and also in the embodiment described in FIG. 8 below.

Figure 8:
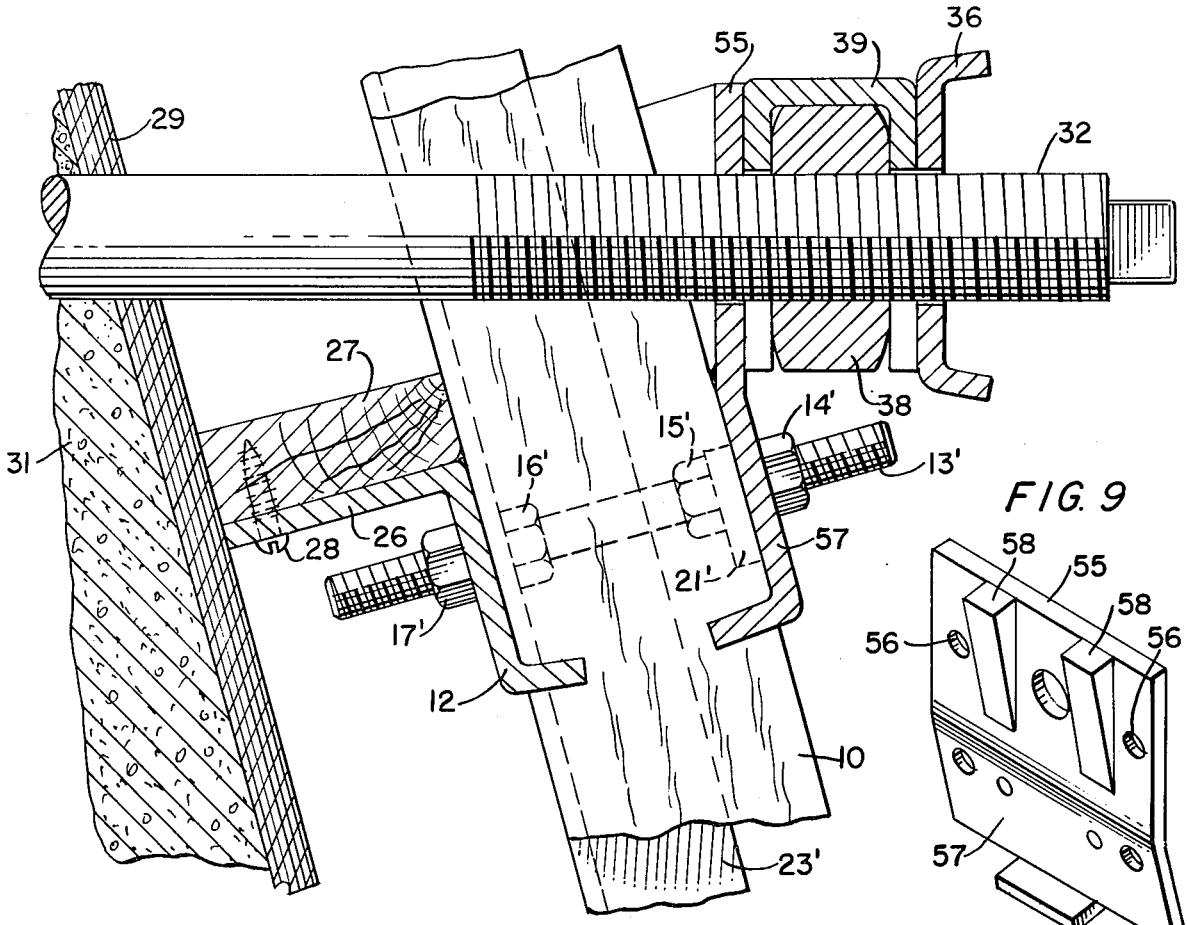
FIG. 8 is a sectioned view of a battered or sloping form utilizing a system of the present invention.
Figure 9:
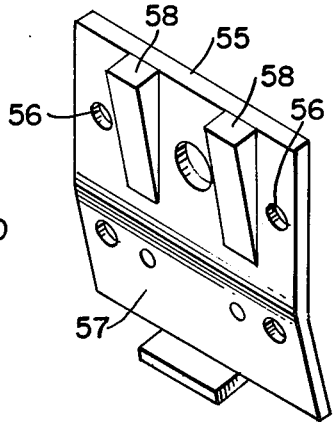
FIG. 9 is a perspective view of a front side plate used with the system of FIG. 8.

FIG. 8 shows the battered or sloping form wherein the strongback or waler structural members 10 and wall form face 29 may incline from the vertical from 0° to 45°. This modification varies from the embodiment of FIGS. 1 through 3 mainly in the construction of front side plate 55. Wall tie 32, housing member 36, keeper 39, back side plate 12, having shelf 26 with wall form portion 27 attached thereto and wall form face 29 are similar to those parts as described in connection with FIGS. 1 through 3. In this embodiment tension stud bolts 13[1] with nuts 14[1] through 17[1] connect only from front side plate 55 to back side plate 12 with punched off center washers 21[1] and vertical slotted washer-angle 23[1] applying forces against member 10 as previously described. Separate bolts not shown pass through holes 56 in the upper portion of front side plate 55 and connect U-shaped housing member 36 to front side plate 55. Even though the members 10 and face 29 are inclined adjustment along wall tie 32 by movement of washer 38 is similar as previously described. In order to maintain the form with the slope as desired the lower portion 57 is bent at the angle of slope desired. Wedge shape portions 58 which may be integral with front side plate 55 maintain the support of members 10 in relation to the upper portion of front side plate 55. Thus only slight modification primarily involving a different front side plate 55 allows the use of a battered or sloping form varying in incline from 0° to 45° but utilizing all of the remaining hardware including the wall form of previous embodiments.

Among the advantages of the present invention as shown in the description of several embodiments is the interchangeable hardware and the adaptability to almost any type of wall form or mechanism for movement of panels along with the simplicity allowing assembly or disassembly with a minimum of tools. In fact a couple of wrenches can be used for full adjustment and assembly or disassembly of the structures.

It will be obvious to those skilled in the art that various changes may be made without departing from the scope of the invention and the invention is not to be considered limited to what is shown in the drawings and described in the specification.

I claim:

1. Apparatus to adjust and maintain spacing between building members comprising a screw type wall tie adapted to extend between the building members, a back side plate having means to attach said back side to one of the building members, a front side plate attached to said back side plate and spaced from said back side plate, a nut mounted for rotation on one end of said screw type wall tie, means to enclose said nut attached to said front side plate and enclosing said nut, said wall tie passing substantially through laterally centered openings in said side plates, and said nut enclosing means, and means to receive and attach to said screw type wall tie mounted on the opposite end of said wall tie and adapted to be attached to the other of the building members.

2. Apparatus of claim 1, further characterized by said means to receive and attach to said wall tie including a back side plate, front side plate, nut, and means to enclose said nut similarly mounted on the opposite end of said wall tie and adapted to be attached to the other end of the building members.

3. Apparatus of claim 1, further characterized by structural members clamped between said front and back side plates.

4. Apparatus of claim 3, further characterized by said attaching means of said back side plate being a substantially horizontal shelf integral with said back side plate.

5. Apparatus of claim 4, further characterized by a wall form portion attached to said shelf and adapted to be attached to a building member.

6. Apparatus of claim 3, further characterized by means for attaching said front and back side plates being tension stud bolts connecting said front and back side plates.

7. Apparatus of claim 6, further characterized by extension portions on said front and back side plates extending between and against the sides of said structural members closest to said tie.

8. Apparatus of claim 7, further characterized by a punched off-center washer on each of said tension stud bolts adapted to press against said structural members on sides of said structural members opposite from said extension portions.

9. Apparatus of claim 7, further characterized by a slotted washer on each of said tension stud bolts adapted to press against said structural members on sides of said structural members opposite from said extension portions.

10. Apparatus of claim 9, further characterized by said slotted washer being an angle bar with elongated slots along the length of one section of said angle.

11. Apparatus of claim 3, further characterized by a slotted keeper fitted with the slot containing said tie within said nut enclosing means.

12. Apparatus of claim 11, further characterized by said keeper extending over said tie on both sides of said nut, said keeper having connected front and back portions, each said front and back portions having slots therein.

13. Apparatus of claim 11, further characterized by said keeper having wider and narrower portions with said wider portion larger than the diameter of said nut and said narrower portion slightly larger than the diameter of said tie.

14. Apparatus of claim 11, further characterized by said centering opening in said nut enclosing means having a diameter larger than the diameter of said nut.

15. Apparatus to adjust and maintain spacing between building members comprising a screw type wall tie adapted to extend between the building members, a back side plate having means to attach said back side to one of the building members, a front side plate attached to said back side plate, said front side plate having one portion inclined to a second portion and to a vertical plane, a nut mounted for rotation on one end of said screw type wall tie, means to enclose said nut attached to said front side plate and enclosing said nut, said wall tie passing substantially through laterally centered openings in said front side plate and said nut enclosing means, and means to receive and attach to said screw type wall tie mounted on the opposite end of said wall tie and adapted to be attached to the other of the building members.

16. Apparatus of claim 15, further characterized by said second non-inclined portion having wedged portions located adjacent thereto.

17. Apparatus of claim 16, further characterized by said wedged portions being integral with said front side plate.

18. Apparatus of claim 1, further characterized by a keeper plate between said front side plate and said nut enclosing means, said keeper plate having a center opening with a diameter larger than the diameter of said nut.

* * * * *